US005092470A

United States Patent [19]

Häkansson

[11] Patent Number: 5,092,470

[45] Date of Patent: Mar. 3, 1992

[54] METHOD AND APPARATUS FOR GRADING OBJECTS IN ACCORDANCE TO SIZE

[76] Inventor: Reinhold Häkansson, Box 183 Jularp, S-243 00 Höör, Sweden

[21] Appl. No.: 467,120

[22] Filed: Jan. 19, 1990

[51] Int. Cl.[5] ..... B07C 5/04; B07C 5/36

[52] U.S. Cl. ..... 209/586; 198/434; 209/535; 209/656; 209/657; 209/908; 209/934

[58] Field of Search ..... 209/657, 656, 655, 934, 209/586, 939, 576, 908, 638, 577, 539, 552; 198/690.2, 699.1, 434, 636, 445, 446

[56] References Cited

U.S. PATENT DOCUMENTS

| | | | |
|---|---|---|---|
| 1,722,751 | 7/1929 | Jones | 209/657 |
| 2,962,165 | 11/1960 | Aller et al. | 209/657 X |
| 3,209,910 | 10/1965 | Palmer et al. | 209/638 |
| 3,655,964 | 4/1972 | Slight | 209/908 X |
| 3,708,065 | 1/1973 | Aull et al. . | |
| 3,872,306 | 3/1975 | Palmer | 209/589 X . |
| 4,088,227 | 5/1978 | Lockett | 209/657 X |
| 4,168,005 | 9/1979 | Sandbank | 209/567 X |
| 4,281,764 | 8/1981 | Fowler, Jr. | 198/699.1 |
| 4,351,437 | 9/1982 | Long | 109/939 X |
| 4,485,912 | 12/1984 | Carmichael et al. | 198/445 X |
| 4,558,786 | 12/1985 | Lane | 209/577 |
| 4,624,367 | 11/1986 | Shafer et al. | 209/586 X |
| 4,901,861 | 2/1990 | Cicchelli | 209/539 |
| 4,946,046 | 8/1990 | Affleck et al. | 209/939 |

FOREIGN PATENT DOCUMENTS

| | | | |
|---|---|---|---|
| 1065772 | 9/1959 | Fed. Rep. of Germany | 198/690.2 |
| 245135 | 4/1987 | Fed. Rep. of Germany | 209/657 |
| 3611926 | 10/1987 | Fed. Rep. of Germany | 209/586 |
| 1343234 | 10/1963 | France | 209/657 |
| 665144 | 4/1988 | Switzerland | 209/657 |
| 749456 | 7/1980 | U.S.S.R. . | |
| 1187740 | 10/1985 | U.S.S.R. . | |
| 1571889 | 7/1980 | United Kingdom . | |

*Primary Examiner*—Donald T. Hajec

*Attorney, Agent, or Firm*—Pollock, Vande Sande & Priddy

[57] ABSTRACT

In a method and apparatus for grading objects according to their size, the objects are advanced along a broad, flat and divided conveyer path. Image data relating to the size of respective objects is obtained with the aid of a camera scanning against a light source. At the correct moment in time, control signals are transmitted to finger groups, preferably four, which function to guide ten or more objects simutaneously in mutually different directions, in accordance with the respective sizes of the objects. In one embodiment, the lowest fingers are replaced with triangular-shaped guidance blocks. A large number of objects can be sorted gently and effectively from the transport path into mutually different, individually selective sizes.

7 Claims, 4 Drawing Sheets

METHOD AND APPARATUS FOR GRADING OBJECTS IN ACCORDANCE TO SIZE

FIELD OF THE INVENTION

The present invention relates to a method and apparatus for grading in accordance with their size objects, for instance potatoes, onions, or other agricultural products.

BACKGROUND ART

There is a great need in agricultural and garden-produce growing industries for grading different products according to their size, in a smooth and trouble-free fashion. Mechanical and electronic grading systems are known in the art. The mechanical systems cause damage to the products and do not result in uniform grading. The electronic systems sort the products singly in a channel or like conveyer, see for example, GB-A-1 571 889, U.S. Pat. No. 4,558,786, U.S. Pat. No. 1,722,751, U.S. Pat. No. 3,708,065, SU-749 456, SU-1 187 740, SU-749 456. Most of these systems are highly expensive in operation at normal capacity requirements. According to the present invention, the objects to be graded in accordance with their sizes are conveyed along a broad, flat conveyer path, and control informations based on image data taken by a camera and indicative of the size of respective objects is transmitted at the correct moment in time to groups of fingers which function to guide the objects in mutually different directions in accordance with their respective sizes. The invention enables a large number of objects to be sorted simultaneously from a conveyer path into mutually different, individually selective sizes. The method and apparatus proposed in accordance with the present invention are more gentle and more reliable in operation than methods and apparatus known hitherto, and are also much less expensive, since they provide a much greater grading capacity, such as 30 or more objects per second.

The invention will now be described in more detail with reference to the accompanying drawings, wherein:

DETAILED DESCRIPTION OF THE PREFERRED EMBODIMENT(S)

Figure 1:
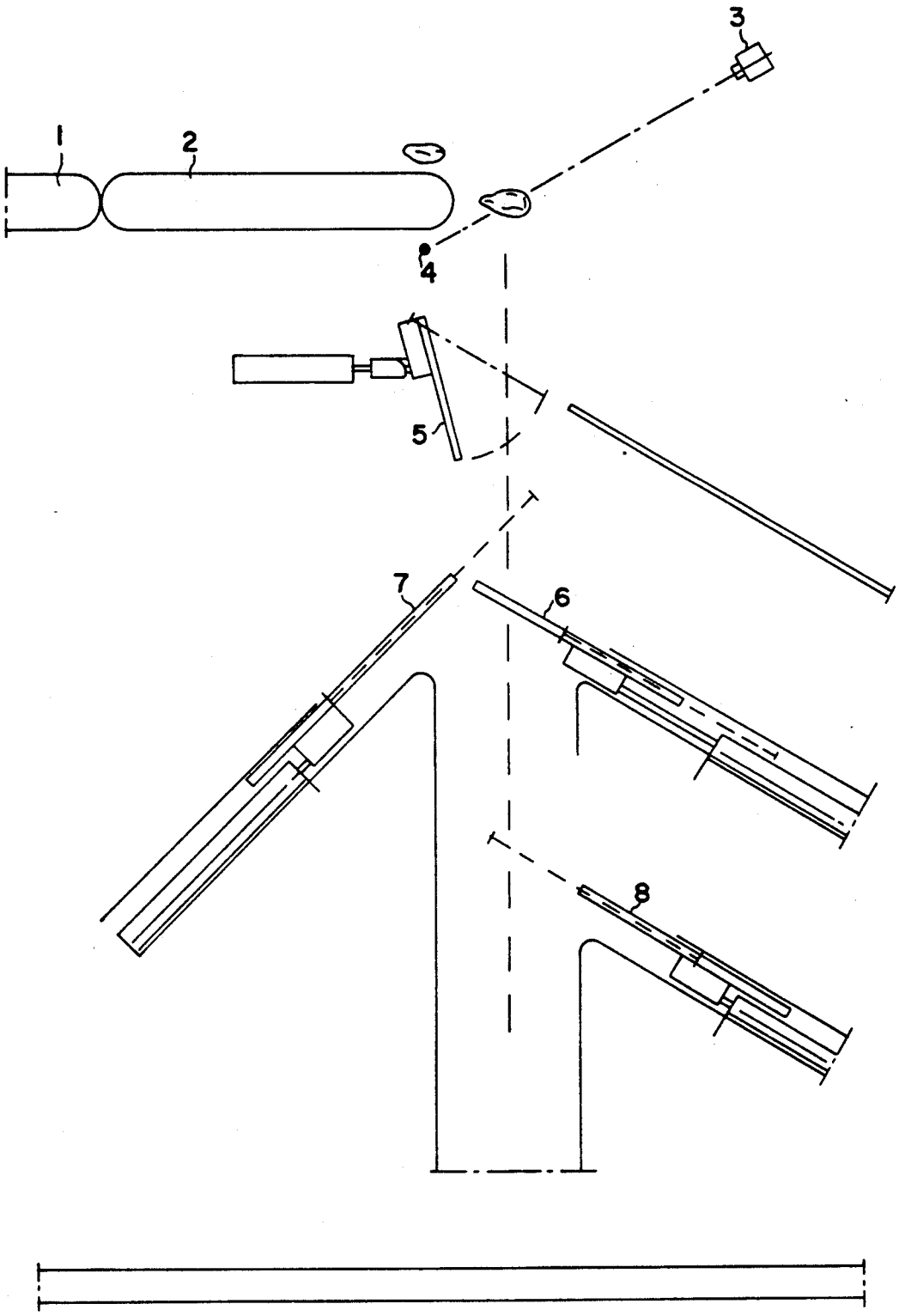
FIG. 1 schematically illustrates one embodiment of a present invention apparatus for grading potatoes into four mutually different size fractions.

The inventive method and apparatus are based on the concept of establishing the volume of respective objects from two-dimensional image data obtained with the aid of a camera 3 which scans against a light source 4, as shown in FIG. 1 to detect the two-dimensional extension of respective objects as they fall freely in front of the light source. Ten or more objects can be scanned simultaneously. Control signals are produced in accordance with the image data obtained, these signals being utilized to activate a first finger group 5 for selection of the largest fraction, a second finger group 6 for selection of the next largest fraction, and a finger group 7 for selection of the next smallest fraction. The smallest fraction falls freely past all finger groups. When practicing the method and apparatus according to the present invention, the flow of objects is accelerated along at divided conveyor path the junction of a first conveyer path 1 to a second conveyer path 2, and therewith separate the objects one from the other in a direction parallel to the movement direction of conveyer path 2, thereby enabling improved image data to be obtained and more positive mechanical grading to be achieved. The finger groups each consist of a number of fingers placed next to one another in a row that is perpendicular to the moving direction of the conveyer paths 1 and 2 and is parallel to the surface of the conveyer paths. All fingers in a group can move individually.

Figure 2:
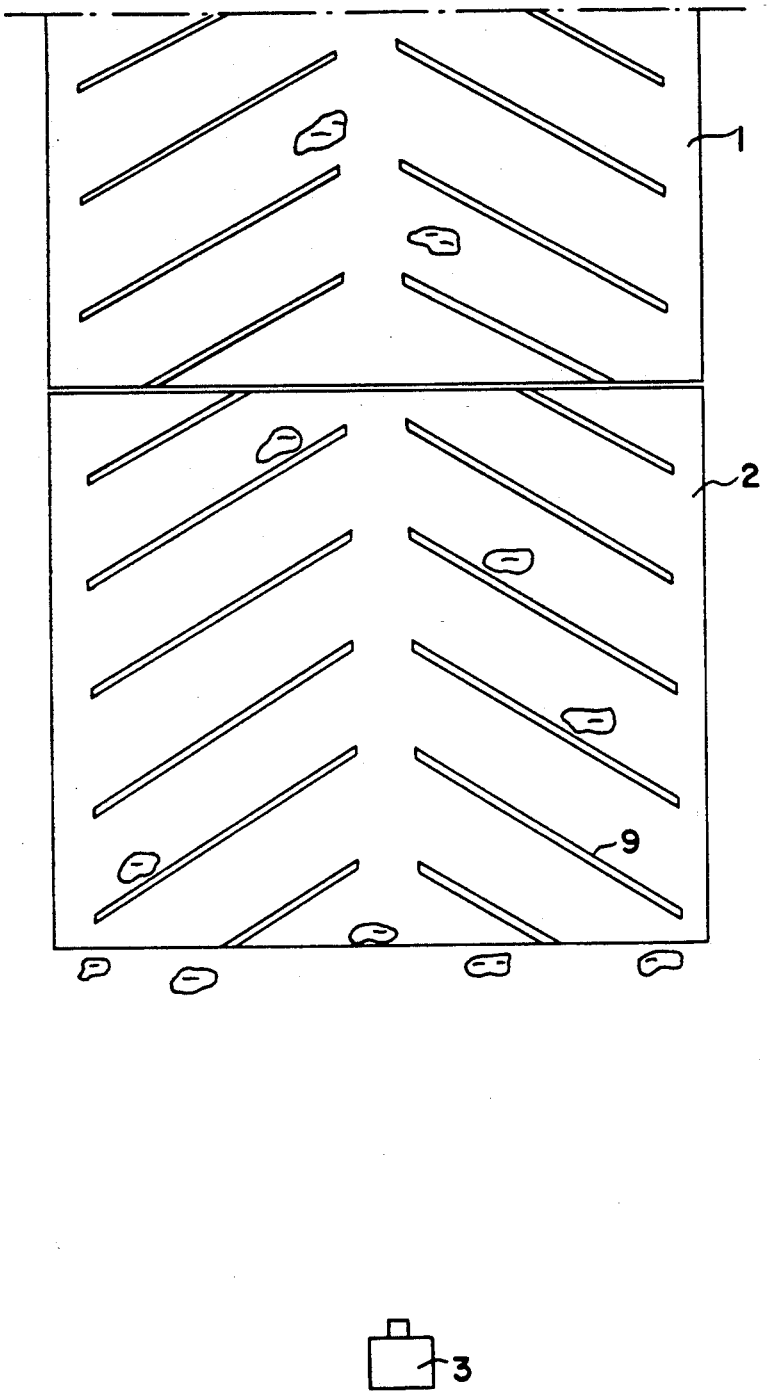
FIG. 2 shows one embodiment of a pattern separating provided on the conveyor's path.
Figure 3:
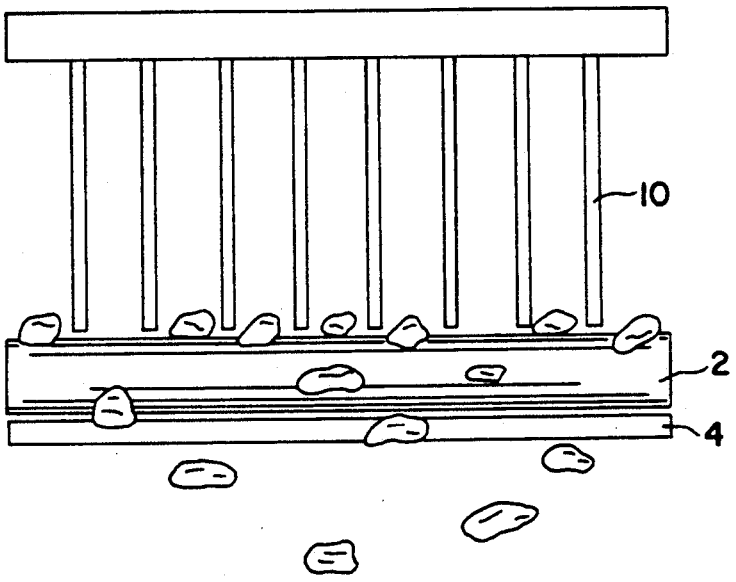
FIG. 3 shows another embodiment of means for separating objects on the conveyor.

Separation of the objects in the direction perpendicular to movement direction of the conveyers can be achieved by providing either one of or both conveyers 1 and 2 with diagonal patterns, for example, formed as parallel ribs 9 extending from the center line of the conveyer path to both edge lines of the conveyer. FIG. 2 shows schematically one embodiment of such patterns. Separation of these objects can also be achieved by placing one or several rows of rubberclad fingers 10 very close above the conveyers 1 and/or 2. FIG. 3 shows schematically one embodiment of such fingers 10. Ribs 9 and fingers 10 can be used in the same apparatus.

A pneumatic pressure valve located adjacent respective finger groups is activated on the basis of the image information. This valve activates a piston-cylinder device, which in turn steers a rubber-clad finger. The finger group 5 has fingers which hang freely and which are activated and steered by a compressed-air piston-cylinder device which functions to move the fingers forwards to a working position. The finger groups 6 and 7 each comprise fingers which are attached to the piston rod of respective compressed-air piston-cylinder devices and move in the working direction thereof. The finger group 6 is normally located in its upper working position, since the next largest fraction normally predominates. The finger group 7 is normally located in its lower working position. When activating the finger group 7, an appropriate number of fingers are longitudinally moved into the flow of falling objects with such speed that the movement is performed before the object reaches the selected finger group, wherewith the object in question is subject to minimal damage and is guided gently back over the finger group 7. When wishing to divide the objects into five mutually different sizes, the apparatus can be complemented with an additional finger group 8, identical to the finger group 6. The best method of utilizing the finger groups, in each individual case, is achieved when taking into account the damage liability of the objects concerned when falling from high heights and also while taking into account the number of fractions or grades into which the objects are to be sorted. The method and apparatus according to the invention enables the objects belonging to the largest fraction, these objects being the most sensitive to impact, to be separated by the rubber-clad fingers after having fallen through a distance of about 13 cm.

Figure 4:
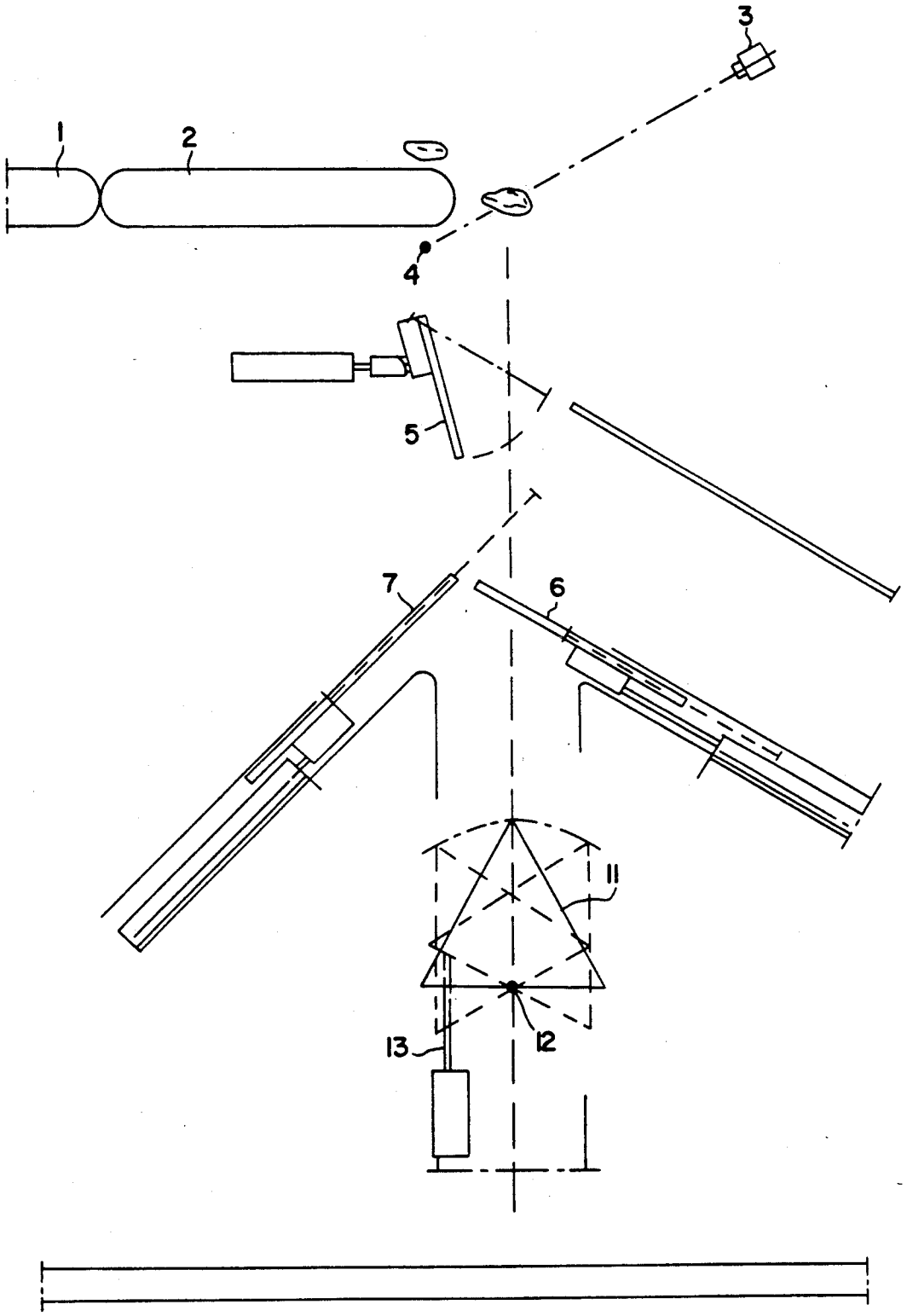
FIG. 4 shows another embodiment of the present invention apparatus shown in FIG. 1.

Another embodiment of the invention is shown in FIG. 4. This embodiment is almost identical with the embodiment shown in FIG. 1 with the single difference that the lowest finger group, that is the group designated with 8 in FIG. 1, is exchanged for a row of triangular shaped guidance blocks 11, the function of which is briefly explained below. Each of the guidance blocks 11 can turn individually around an axis 12 with the help of a piston 13. By turning a block 11 to the left, an object hitting the block is guided to the right. By turning the block to the right, the object is guided to the left. By using blocks 11 instead of finger groups as the last selecting unit, a double selection function can be achieved with one unit. Additionally, a more gentle handling of objects having fallen a long distance, and thus having reached a higher speed, is achieved.

It is evident that the concept of the present invention covers any number of grading sizes. The invention also covers different designs for moving the finger groups. Each finger group can be moved either longitudinally in a direction parallel to the piston-cylinder, as with finger groups 6 and 7, or in a swinging motion, as with finger group 5.

I claim:

1. An apparatus for grading objects in accordance with their size, comprising:

a broad conveyor path for advancing objects along the conveyor path;

means for obtaining image data corresponding to the size of the object freely falling at an end of the conveyor path; and a plurality of groups of object directing members receiving control signals which are transmitted thereto from said means for obtaining the image data;

the groups of object directing member including a plurality of members forming a row, with said members being individually movable within the row; and means for actuation of members within at least one of the groups to enable grading simultaneously a plurality of objects of different sizes; and wherein at least the lowest group of object directing members along a path of falling objects includes at least one row of triangular-shaped guidance blocks which can turn individually around an axis with the help of a piston such that if a block is turned to the left, an object hitting the block is guided to the right, and if a block is turned to the right, an object hitting the block is guided to the left.

2. An according to claim 1, wherein said groups of object directing members include finger groups including a plurality of thin rubber-clad fingers.

3. An apparatus according to claim 2, wherein at least one of the finger groups includes longitudinally movable fingers.

4. A grading apparatus according to claim 3, wherein the fingers of the finger groups are firmly attached to piston rods of pneumatic piston-cylinder devices, which effect rapid and precise movement of the fingers.

5. An apparatus according to claim 1, wherein the conveyor path is divided into two parts, such that the objects are advanced along a first part of the divided conveyor path at a first speed and along a second part of the conveyor at a higher speed than the first speed, whereby the objects are accelerated and disbursed before falling from the conveyor to enable obtaining of improved image data and improved positive grading.

6. An apparatus according to claim 5, wherein the conveyor path is provided with diagonally arranged ribs, which disburse the objects perpendicularly.

7. An apparatus for grading objects in accordance with their size, comprising:

a broad conveyor path for advancing objects along the conveyor path;

means for obtaining image data corresponding to the size of the object freely falling at an end of the conveyor path;

a plurality of groups of object directing members receiving control signals which are transmitted thereto from said means for obtaining the image data, the groups of object directing member including a plurality of members forming a row, with members being individually movable within the row; and means for actuation of members within at least one of the group to enable grading simultaneously a plurality of objects of different sizes; and wherein at least one group of object directing members includes a plurality of longitudinally movable finger members, and in addition, at least one row of triangular-shaped guidance blocks which can turn individually around an axis with the help of a piston such that if a block is turned to the left, an object hitting the block is guided to the right, and if a block is turned to the right, an object hitting the block is guided to the left.

* * * * *